United States Patent [19]

Looker

[11] Patent Number: 4,538,663

[45] Date of Patent: Sep. 3, 1985

[54] CARGO CONTAINER

[76] Inventor: Robert Looker, 405 Toro Canyon Rd., Carpinteria, Calif. 93013

[21] Appl. No.: 598,407

[22] Filed: Apr. 12, 1984

Related U.S. Application Data

[63] Continuation-in-part of Ser. No. 487,274, Apr. 21, 1983, abandoned.

[51] Int. Cl.[3] ..... A47H 3/00

[52] U.S. Cl. ..... 160/368 R; 220/1.5

[58] Field of Search ..... 160/328, 368 R; 220/1.5

[56] References Cited

U.S. PATENT DOCUMENTS

| | | | |
|---|---|---|---|
| 3,591,034 | 7/1969 | Lohr | 220/1.5 |
| 3,882,575 | 5/1975 | Jolly | 160/368 R |
| 3,926,243 | 12/1975 | Lovich et al. | 220/1.5 |
| 4,046,186 | 9/1977 | Nordstrom | 160/368 R |
| 4,212,406 | 7/1980 | Mittelmann . | |
| 4,429,730 | 2/1984 | Elston | 160/368 R |

*Primary Examiner*—Peter M. Caun
*Attorney, Agent, or Firm*—Lyon & Lyon

[57] ABSTRACT

A box-like container typically used in the transportation of cargo by air having an improved door closure apparatus. The favored air cargo container has a base pallet having a front and rear hoop attached thereto, to which aluminum sheets are attached to enclose the container leaving one or more door openings. Each of the hoops consists of two corner posts and a top crosspiece member therebetween. A piece of fabric material sufficient to cover the door opening of the container is attached to the crosspiece member above the door opening. An elongate bar extends along the bottom width of the fabric material. Pins on the elongate bar will engage hooks on the corner posts. A pair of cables are attached at either end of the elongate bar below the pins and extend upward along and are attached to each side of the fabric material and then diagonally across the back of the fabric piece to the other end of the elongate bar. The door closure apparatus is secured by rotating the bottom bar to place the pins on the ends of the elongate bar under hooks on the corner posts on either side of the door opening. The bottom bar is then rotated back flush against the corner post pulling the side cables tight across the door opening and into a channel formed in the corner post. The door closure apparatus for this container combines the low cost and light weight of a fabric door covering with the strength and durability of a steel cable system.

6 Claims, 16 Drawing Figures

CARGO CONTAINER

This is a continuation-in-part of application serial No. 487,274, filed Apr. 21, 1983, to be abandoned.

BACKGROUND OF THE INVENTION

1. Field of Invention

The invention herein described and claimed pertains generally to air cargo containers; more particularly, to a door closure apparatus for such an air cargo container.

2. Prior Art

Air cargo containers have been utilized for the transportation of cargo by aircraft for many years. The cargo is loaded first into the container, and the containers are then loaded into the aircraft. This was found to be far superior to loading the cargo directly into the cargo space of the aircraft. Far less time is required to load or unload the aircraft with a limited number of air cargo containers than would be required to load the cargo directly on the aircraft. Furthermore, because the cargo containers are designed and constructed to correspond to the interior dimensions of the air cargo space, the containers fit more snugly in the space and therefore do not shift during transportation. These and other advantages of the air cargo container have made the cargo container ubiquitous in the air cargo industry.

As with most machinery used in the air transportation industry, the two primary requisites in the design of a cargo container are that it be strong and that it be light. These goals, being inherently divergent, are difficult to obtain.

Favored air cargo containers are constructed almost entirely of aluminum, which provides the best mating of light-weight and strength. A cargo container has a base portion which more or less is an aluminum pallet. Usually the pallet is rectangular in shape. Attached to the base is an aluminum box having one or more doors. The box is typically constructed of two "hoops", resembling croquet wickets, each comprising two corner posts and a cross-piece member therebetween. There is a front hoop attached to the front of the base and a rear hoop attached to the rear of the base. Aluminum sheets are attached to the various corner posts and cross-piece members to complete the closure of the box, except for the front and/or rear which will become the door opening(s) for the container.

A consistent problem encountered in air cargo containers is with respect to the door closure apparatus. Again, strength, durability, and light-weight are desired characteristics in any door closure apparatus. The preferred door closure apparatus will be inexpensive, easy to use, easy to repair, weather proof, resistant to pilferage, strong, durable and light-weight, and, when closed, will support the structure when cargo shifts against the side sheets.

There are a number of door closure designs which are currently in use. Some utilize aluminum flaps of various designs which are hinged at the top of the door opening and at the center and are folded to a position at the container top when open. These designs suffer one or more of the drawbacks of expense, excess weight and/or poor performance.

Other designs incorporate fabric door closure means which are held in place in several different ways, including VELCRO self-sticking fabric at the sides. These designs, while typically inexpensive and light-weight, suffer from drawbacks in performance, strength and durability. Furthermore, these types of door closures are not sufficiently resistant to pilferage.

Therefore, there exists a need in the art for an improved air cargo container door closure apparatus.

SUMMARY OF INVENTION

The invention herein described and claimed provides such an improved door closure apparatus which utilizes fabric for light-weight and low cost, with a cable system for structural strength, durability and performance. The fabric material is attached along the upper edge of the door opening, and hangs downwardly therefrom to cover the entire door opening area. The bottom of the fabric is attached to a bottom bar assembly which is primarily an elongate metal bar which extends the width of the fabric. Each side of the fabric is looped and sewn around a cable which extends the entire height of the fabric and is attached at one end to the elongate bar. From there, the cable extends to the top of the door closure opening, and diagonally down across the back of the fabric and is attached to the elongate bar at its opposite end to create a criss-cross with the cable on the other side of the fabric. Each cable is positioned so that it travels along the corner post on either side of the door opening. A channel is formed in each of the corner posts to receive the cable. When the door is closed, the cables, and hence the fabric attached to the cables, are pulled tightly into those channels, thereby protecting the contents from weather and pilferage. Additionally, this criss-crossing cable system, wherein the cables are tensioned by the over-center action of the elongate bar in closing (discussed more fully infra), provides rigidity, as the cables act as tension trusses, to the overall structure of the container and also provides strength to the door closure apparatus itself.

The door apparatus is closed by a simple "over center" arrangement and action of the elongate bar. A hook is attached to each of the corner posts on either side of the door opening. A pin is attached on either side of the elongate bar. The pins are located above the point where the cables are attached to the elongate bar. This allows the pins to be placed under the hooks by rotating the elongate bar upwardly at the point where the cables are attached thereton. This is done by the operator grasping the elongate bar and twisting it outwardly and upwardly while pressing the fabric against the door opening until the pins can be placed under the hooks on the corner posts. The elongate bar is then rotated downwardly into place pulling the cables tight in the channels and tensioning the cable which criss-cross diagonally over the door opening. The pins, the hooks, and the length of the cable are arranged and adjusted such that when the pins are placed under the hooks, the cables will be pulled tight into the channels as the elongate bar is rotated downward to lock the door in place. The pins therefore act first as pivot members to tension the cables, then as holding means to hold the cables taut.

A simple hook apparatus is provided whereby the elongate bar may be locked to the base of the container, although this is not required.

Using this door closure apparatus, sufficient strength and rigidity are achieved so that the cargo container can be made with two door openings, one on either side of the container. This was not possible with previous fabric door openings because the fabric did not provide the requisite strength and rigidity.

DESCRIPTION OF THE FIGURES

FIG. 2 is taken along line 2—3 in FIG. 1. The nut and bolt attachment means provides for adjustment of the length of the cable.

DETAILED DESCRIPTION OF THE PREFERRED EMBODIMENT

Figure 1:
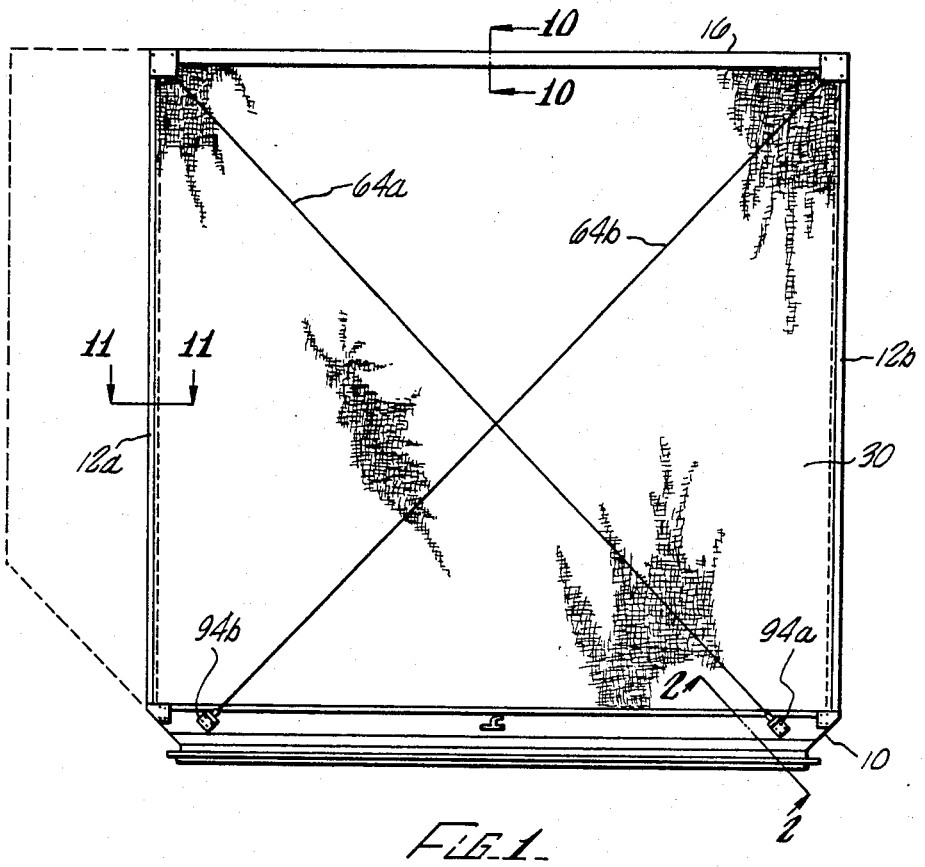
FIG. 1 is a rear view (looking from inside the container out) of the door closure apparatus of the invention. The criss-crossing cables of the door closure apparatus when it is in the closed position is prominently shown. An extending box wing portion (shown in phantom) is often added to the container, but is not shown here for simplicity.

Unless otherwise specified, the components of the air cargo container hereinafter described are preferably constructed of aluminum. A cargo container has a base 10. Base 10 in some containers is similar to an aluminum pallet traditionally used for the stacking and movement of materials by a forklift. In that event, the base 10 is formed to accommodate the forks of a forklift so that the cargo container can be picked up and transported by means of the common forklift. In other containers, and as shown here, the base 10 is not constructed to accommodate a forklift, but is flat. The base 10 is square. Attached at each corner of the base 10 by conventional means are front corner posts 12*a* and 12*b* and rear corner posts (not shown). Extending between the tops of front corner posts 12*a* and 12*b* and between rear corner posts are a front cross member 16 and a rear cross member (not shown), respectively. The corner posts and the cross members are rectangular in cross section and formed of rolled aluminum for strength.

Aluminum flanges 24 are attached to the corner posts, and aluminum sheets 26 are attached to the flanges by rivets 27 or other means to enclose the cargo container. At least one side of the cargo container is not covered and will provide the door opening for access to the container.

Figure 10:
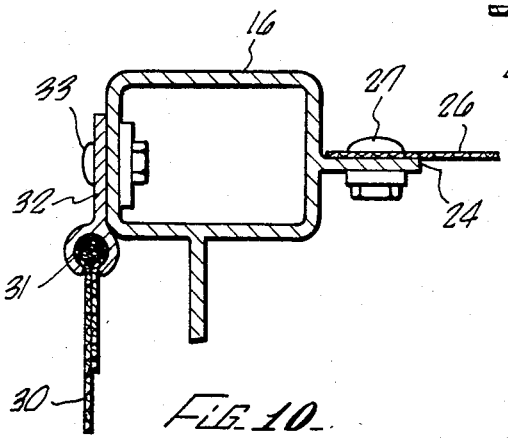
FIG. 10 is a cross-section taken along line 10—10 in FIG. 1 showing the means by which the fabric is attached to the cross-piece member.
Figure 11:
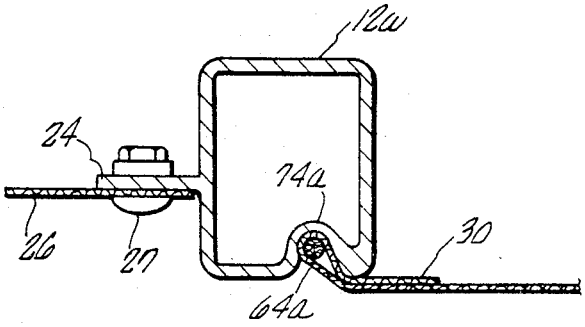
FIG. 11 is a cross-sectional view taken along line 11—11 in FIG. 1 showing the manner in which the cable and fabric is pulled tight into the channel of the corner piece when the door closure is in the closed position.

A door closure apparatus is required to close and secure the door opening of the cargo container. The door closure apparatus comprises a piece of fabric material 30 which is attached to the cross member 16 above the door opening by any conventional means. As shown in FIG. 10, the preferred means is a bracket 32 attached to the cross piece member 16 by conventional bolt means 33. The fabric piece 30 is looped around a metal rod 34 and sewn. The metal rod 34 with the fabric looped thereabout is inserted into the channel of bracket 32.

Figure 9:
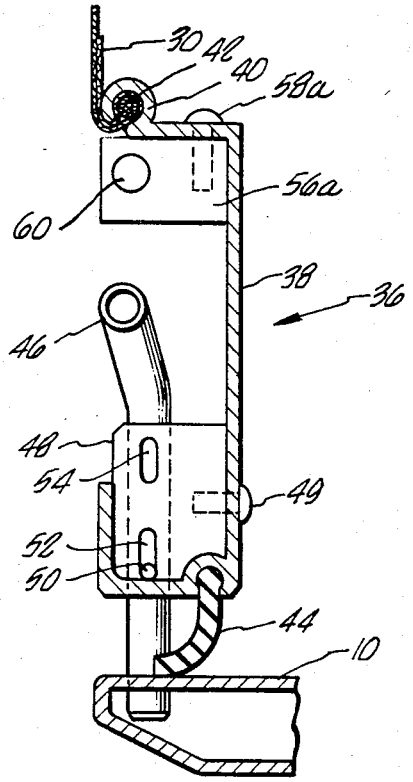
FIG. 9 is a cross-section showing the attachment means whereby the bottom bar assembly is attached to the base of the cargo container. Also shown is the manner in which the fabric is attached to the bottom bar assembly.

The bottom end of fabric piece 30 is attached to bottom bar assembly 36. As best seen in FIG. 9, bottom bar assembly 36 consists primarily of elongate plate 38 to which the fabric piece 30 is attached by means of bracket 40 into which a metal rod 42, around which the fabric piece 30 is wrapped and sewn, is inserted. Elongate plate 38 has a hard rubber weather strip 44 attached to the bottom edge thereof. When the door closure apparatus is in the closed position, the weather strip 44 seals against the container base 10 to weather proof the bottom side of the door closure apparatus.

Also attached to elongate plate 38, roughly in the center thereof, are locking means by which the door closure apparatus may be locked in place. The locking means comprises a cane 46 which is slidable within a guide box 48 which is attached to elongate plate 38 by conventional screw means 49. A guide pin 50 communicates with slot 52 to control the movement of cane 46 within guide box 48. Another slot 54 in guide box 48 corresponds to an aperture in the cane to provide for locking of the cane in position and for insertion of a customs tag. The lower end of cane 46 engages an aperture in base 10 to lock the door closure apparatus into place in the closed position. Because the door closure apparatus of this invention utilizes an "over-center"

means to close the door, the locking means described above can be omitted. They are included only for added security.

Figure 6:
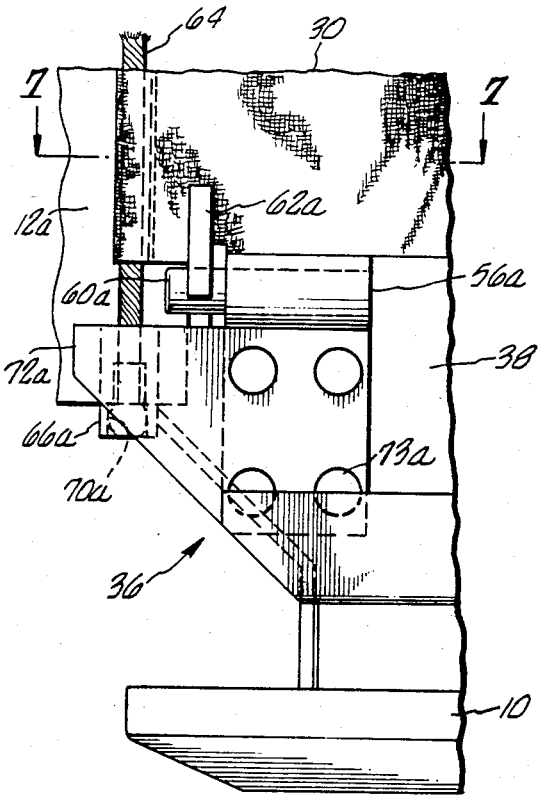
FIG. 6 is a front view, in isolation, of one corner of the cargo container with the door closure apparatus in the closed position, showing the fabric which is attached to the bottom bar assembly, and sewn around the cable, as well as the pin which has engaged the hook. Also shown is the manner in which the cable is attached to the bottom bar assembly below the center point of the pin. This arrangement allows for the bottom bar assembly to be rotated about the point where the cable is attached to the bottom bar assembly, thereby allowing the pin to be manually inserted under the hook for closing.
Figure 7:
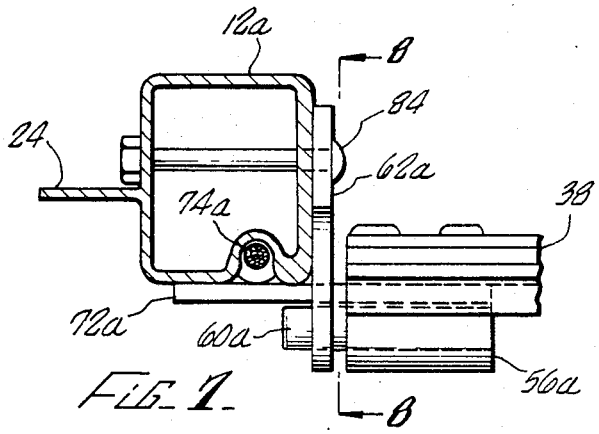
FIG. 7 is a cross-section taken along line 7—7 in FIG. 6 showing the channel in the corner post in which the cable, and hence the fabric, reside when the door closure apparatus is in the closed position. The bottom bar assembly, the pin and the hook are also shown.
Figure 8:
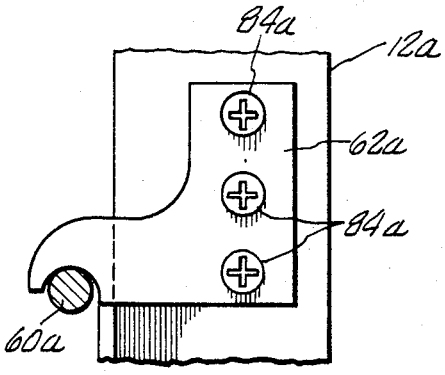
FIG. 8 is a side view along line 8—8 in FIG. 7 showing the shape of the hook attached to the corner post and the manner in which the pin is engaged thereunder.

At the upper end of elongate plate 38, and at either side thereof, are attached pin holders 56 by conventional screw means 58. Note that only one side of the door closure apparatus is shown in FIGS. 4–9, 11, 12 and 14–16. Those components which have a mirror-image component on the other side thereof are designated in the Figures by the notation "a" for the left hand side and "b" for the right hand side; vis. 60*a*. In this specification, the "a" and "b" shall not be used, it being understood that those components shown in the figures as an "a" component have a mirror-image "b" component at the other end of the door closure apparatus, and vice versa, which may or may not be shown in the figures. As can be seen in FIGS. 6, 7 and 9, a pin 60 is housed in a pin holder 56 and extends outwardly therefrom a sufficient distance so that pin 60 will abut corner post 12. Pin 60 provides two functions. First, it is a pivot member about which the bottom bar assembly 36 is rotated in closing the door and pulling the cables tight. (Discussed more fully infra). Second, the pins hold the cables tight after the door has been closed.

Attached to the interior side of each of corner member 12 by conventional screw means is hook 62. The nose portion of hook 62 extends forwardly of corner post 12 to provide engagement means for pin 60.

Looking at FIG. 6, which shows one end of the bottom bar assembly 36, the important interaction of several of the components of the door closure apparatus is shown. Fabric 30 is shown attached to the upper edge of the elongate plate 38. The side of fabric 30 is looped around and sewn to a steel cable 64. Cable 64 is attached at the first end within cable holder 66 which has a reduced diameter channel extending therethrough to present a shoulder 68 against which the nob 70 on cable 64 abuts to hold cable 63 immovable at this end.

Cable holder 66 is welded to an extension plate 72 which is attached to elongate plate 38 by convention rivet means 73 and extends beyond the elongate plate 38 a sufficient distance such that extension plate 72 abuts the corner post 12 so that the cable 64 will reside within channel 74 formed in the corner post 12. Located above extension plate 72 on elongate plate 38 is pin holder 56. Pin 60 is held by pin holder 56 and extends outwardly therefrom so as to engage hook 62 which is attached by conventional nut and bolt means 84 to the interior side of corner post 12. It is important to note that the center line of pin 60 is above the point on elongate plate 72 where cable 64 is attached thereto. This is important because it allows the elongate plate 38 to be rotated about that point where cable 64 is attached to elongate plate 38 so that pin 60 can be inserted under hook 62. In other words, the operator can grasp the lower edge of the elongate plate 38 and, pressing the top edge of elongate plate 38 against the cargo container and lifting outwardly and upwardly on the lower portion of elongate plate 38, cause the plate 38 to rotate at the point where cable 64 joins extension plate 72, thereby causing the center line of pin 60 to be rotated downwardly so that pin 60 can be pushed under and into engagement with hook 62. At that point, the bottom portion of elongate plate 38 can be snapped back into position flush against corner post 12, pulling down on the fabric 30 and the cable 64. This "over-center" operation allows for quick, easy manual closing of the door and results in a tensioned-cable closure.

Figure 2:
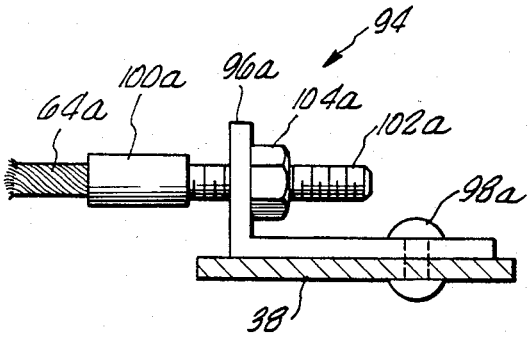
FIGS. 2 and 3 are the side and top views, respectively, of the attachment means whereby a cable is attached at one end to the bottom bar assembly.
Figure 3:
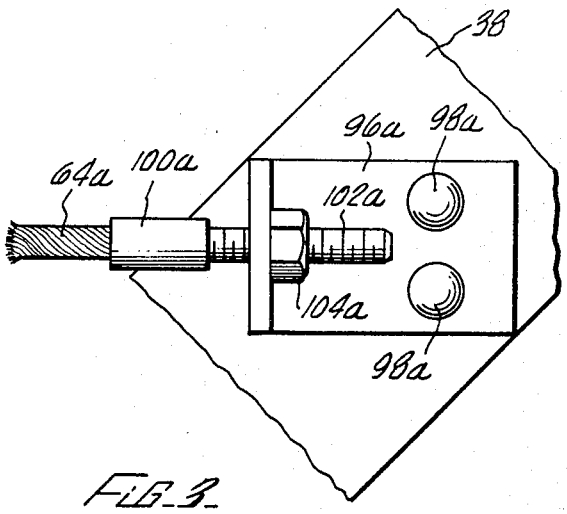
Figure 4:
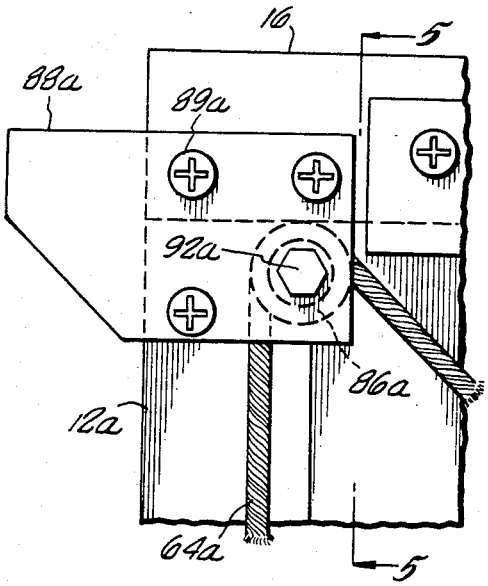
FIG. 4 shows the manner in which the cables are threaded about a spindle at the top of the corner posts.
Figure 5:
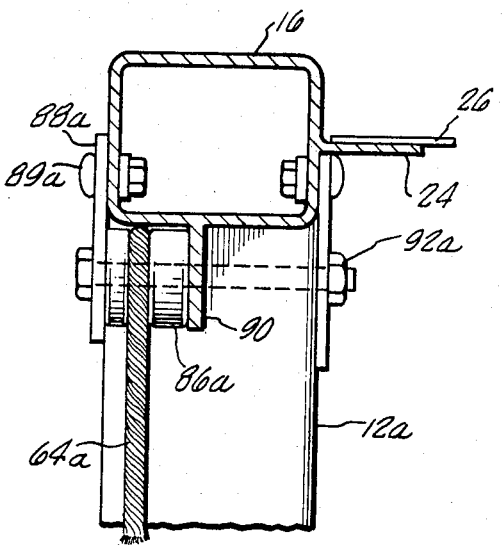
FIG. 5 is a cross-section taken along lines 5—5 in FIG. 4 showing the manner in which the spindle is placed in the corner post.

Cable 64 extends upwardly along the side of fabric 30. At the top of corner post 12, cable 64 is inserted through an aperture in the channel 74 to the interior of corner post 12. Inside corner post 12, cable 64 is threaded around a spindle 86 which is attached therein between cover plate 88, which is attached to corner post 12 by conventional rivet or screw means 89 and flange 90 which depends downwardly from cross piece member 16 by conventional nut and bolt means 92. From there, cable 64 extends downwardly, diagonally across the back of fabric sheet 30 to attachment means 94 at the opposite end of elongate plate 38. The attachment means, shown in FIGS. 2 and 3, is a simple L bar 96 which is riveted to elongate member 38 by conventional rivets 98. The end of cable 64 is there joined by coupler 100 to bolt 102. Bolt 102 is extended through an appropriately sized aperture in L bar 96. A nut 104 threaded on bolt 102 keeps the cable 64 from pulling loose and also provides adjustment means whereby cable 64 can be tightened or loosened. Another cable is attached to the opposite end of elongate plate 38 and extends therefrom up the opposite side of fabric 30, in mirror image fashion of cable 64. The length of the cables are adjusted so that pin 60 can be easily inserted under hook 62, but such that the cables will be stretched tightly when the elongate bar 38 is snapped back into place flush against corner posts 12.

Figure 12:
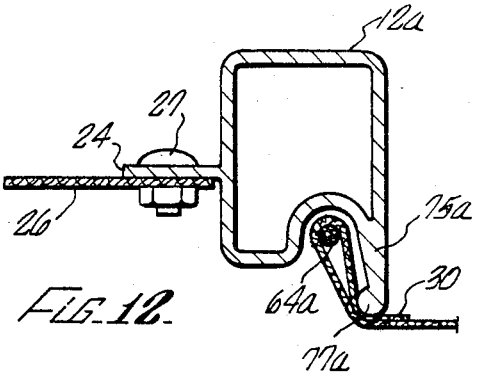
FIG. 12 is a similar view to that in FIG. 11, but showing an alternate embodiment of the corner post having an extending flange to provide for an improved seal between the fabric and the corner post.

It will be appreciated that this operation can be done manually, quickly and easily, by the operator who simply grasps the elongate bar 38 and rotates it upwardly and outwardly until he can insert pins 60 under hooks 62. At that point, the elongate bar is pushed downwardly until it snaps back into position flush against corner posts 12. The act of pushing the elongate plate back into position tightens the cables 64. Tension created thereby holds the pins 60 securely under hooks 62. Also, because the cables are stretched tightly, there is intimate and stressful contact between the fabric 30 which is looped around cable 64 and the channels 74. Accordingly, there is excellent sealing of the door closure apparatus on the sides thereof. Additionally, because cable 64 is held securely in the channels of the corner post, and are stretched criss-cross fashion across the door opening, the strength and stability of the container are enhanced, as the corner posts are anchored and there is steel cable stretching across the opening to keep the cargo from shifting against and breaking the fabric covering. An alternate embodiment of the corner posts 12, shown in FIG. 12, provides for increased sealing. Here, a flange 75 extends outwardly from the corner post 12. A rounded bead 77 provides a smooth point of contact between the fabric 30 and the flange 75.

Figure 13:
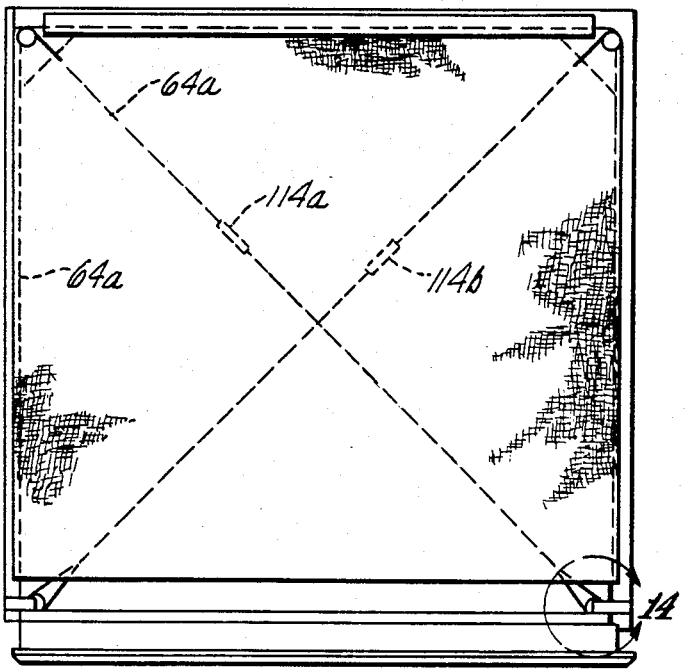
FIG. 13 is a rear view (looking from inside the container out) of the the door closure apparatus of this invention, showing the positioning of an alternate means for attachment of the crisscrossing cables to the elongate bar.
Figure 14:
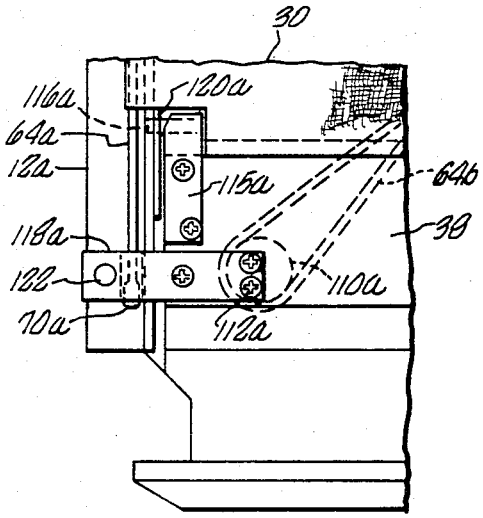
FIG. 14 is a front view of the lower left hand portion of the cargo container with the door closure apparatus in the closed position showing alternate means for attaching the cable to the elongate bar.
Figure 15:
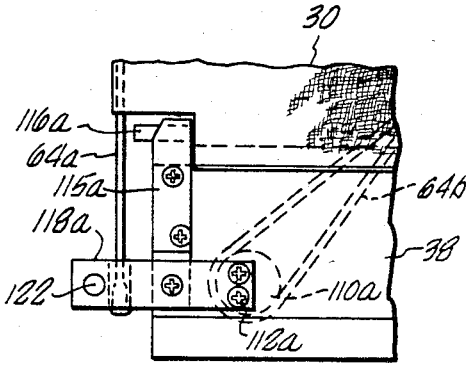
FIG. 15 is a front view of the lower left hand portion of the door closure apparatus in isolation, showing the fabric, elongate bar, cable and pin, with the cargo container structure omitted.

An alternate embodiment for the door bottom assembly is shown in FIGS. 13 through 15. As best seen in FIGS. 14 and 15, an alternate means for attaching cable 64 to the elongate plate 38 is shown. A spindle 110 is attached to elongate plate 38 by conventional screw means 112. The cable 64 is looped around the spindle and secured to itself by conventional means. Tensioning of the cables in this embodiment is provided by conventional turn-buckles 114. A modified pin holder 115 is attached to the bar 38 by conventional screw means.

In this embodiment, the distance between the pin 116 and the modified cable holder bar 118 is increased to provide for greater rotational movement of the pin 116 for easier placement of the pin under hook 120. Lastly, in this embodiment, the cable holder 118 is extended beyond its attachment point with cable 64 and provided with aperture 122 which, when the door closure apparatus is in the closed position, aligns with an aperture in the corner/post 12 for placement of the customs tag. In this embodiment, the locking mechanism shown in FIG. 9 is not required.

Figure 16:
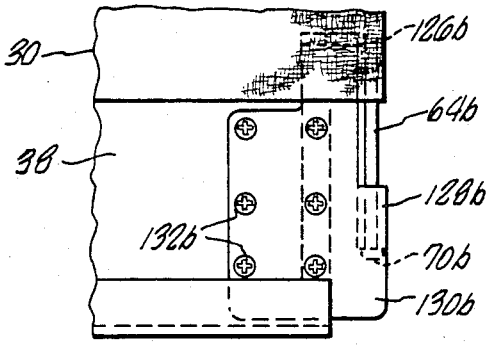
FIG. 16 is a front view showing alternate means for attaching the hook and the cable to the elongate bar.

In FIG. 16, a modified embodiment of the bottom bar assembly is shown in which the pin 126 and the cable holder 128 are of unitized construction, being formed integrally with a single metal plate 130 which is attached to the elongate bar 38 by conventional screw means 132.

While specific embodiments of the invention herein claimed have been described and shown, it will be apparent to those skilled in the art that many modifications on these embodiments are possible without departing from the inventive concepts herein claimed. Accordingly, this patent and the protection provided hereby is not limited to the specific embodiments set forth above, but is of the full breadth and scope of the appended claims.

What is claimed is:

1. In a cargo container having a base, corner posts extending upwardly therefrom, cross pieces between the corner post and side sheets attached to the corner posts, base and crosspieces to define a box-like container having one or more door openings, a tensionable sealing and load supporting fabric door closure apparatus for each door opening comprising:

(a) a piece of fabric material attached at its first end to the crosspiece above the door opening;

(b) an elongate bar attached to the second end of said piece of fabric material;

(c) pin means attached to said elongate bar for engaging hook means attached to the cargo container on either side of the door opening; and (d) cable means for sealing and tensioning the cargo container, said cable means attached at either end of said elongate bar at a point below said pin means and extending up and attached to the edges of said piece of fabric material and to the top of the corner posts on either side of the door opening such that when said pin means engages said hook means, and said elongate bar is brought flush against the door opening, said cables are pulled taut.

2. The invention of claim 1 further comprising an exterior channel formed in each corner post on either side of the door opening in which said cable means will reside when the door closure apparatus is in the closed position.

3. The invention of claim 1 or claim 2 wherein said cable means comprises two cables, each of which is attached to opposing ends of said elongate bar, extends up along and is attached to the edge of said fabric material, and up to the upper corner of the door opening where it is looped about spindle means attached to the cargo container and thereafter extending across said fabric material and attached to the opposite end of said elongate bar, such that in the closed position, said cables criss-cross the door opening and are pulled taut to provide rigidity to the container as well as binding the fabric material against the corner post.

4. The invention of claim 3 wherein means for adjusting the length of said cables are attached to said cables.

5. A cargo container having a tensionable sealing and load-supporting fabric door covering comprising:

(a) a base and a plurality of corner posts extending thereabove, an upper cross-piece between each said corner post and side sheets between them to form and define the sides of the container and one or more door openings;

(b) hook means attached to each said corner post on each side of said door openings;

(c) a channel extending substantially the length of each corner post on each side of each said door opening:

(d) a piece of fabric material attached to and depending downwardly from said upper cross-piece above each said door opening, said fabric piece of sufficient size to substantially cover said door opening;

(e) a bottom bar assembly attached to the end of each said piece of fabric material distal from said upper cross-piece, said bottom bar assembly comprising:

(i) an elongate bar attached to and extending the width of said fabric piece; and (ii) pin means on said elongate bar for engaging said hook means on said corner posts; and (e) at least two cables, one each attached to the opposite ends of said elongate bar such that when said bottom bar assembly is in the closed position, each said cable is positioned substantially in said channel in said corner post on either side of said door opening, the point of attachment of said cable to said elongate bar being below (relative to said piece of fabric material) the center point of said pin means, each said cable extending therefrom upwardly along and attached to the side of said fabric piece, to the top of said post, such that when said bottom bar assembly is in the closed position, said cable is pulled taut in said channel of said post.

6. The invention of claims 2 or 5 wherein each corner post on either side of the door opening has a flange extending outwardly therefrom.

* * * * *